US008002300B2

(12) United States Patent
Ludovici et al.

(10) Patent No.: US 8,002,300 B2
(45) Date of Patent: Aug. 23, 2011

(54) REAR WHEEL MOUNTING ASSEMBLY FOR A WHEELCHAIR

(75) Inventors: Alan N. Ludovici, Kennewick, WA (US); David V. Berriochoa, Pasco, WA (US)

(73) Assignee: TiSport, LLC, Kennewick, WA (US)

( * ) Notice: Subject to any disclaimer, the term of this patent is extended or adjusted under 35 U.S.C. 154(b) by 709 days.

(21) Appl. No.: 11/864,422

(22) Filed: Sep. 28, 2007

(65) Prior Publication Data

US 2009/0085321 A1 Apr. 2, 2009

(51) Int. Cl.
*A61G 5/10* (2006.01)

(52) U.S. Cl. ..... 280/250.1; 180/907; 280/304.1; 280/649; 280/657

(58) Field of Classification Search ..... 280/250.1
See application file for complete search history.

(56) References Cited

U.S. PATENT DOCUMENTS

| | | | | |
|---|---|---|---|---|
| 5,060,962 | A | 10/1991 | McWethy | |
| 6,247,717 | B1 * | 6/2001 | Lovins et al. | 280/250.1 |
| 7,249,777 | B2 | 7/2007 | Schreiber | |
| 2003/0189317 | A1 | 10/2003 | Chen et al. | |
| 2006/0087103 | A1 * | 4/2006 | Schreiber et al. | 280/649 |
| 2006/0097478 | A1 | 5/2006 | Goertzen et al. | |

FOREIGN PATENT DOCUMENTS

| | | |
|---|---|---|
| JP | 05015554 | 1/1993 |
| JP | 09238984 | 9/1997 |

OTHER PUBLICATIONS

TiLite Rigid Owners Manual, Chapter 8: Camber Tubes (Center of Gravity; Rear Seat Height).
Invacare, ProSpin X4 Owners Manual, Section II, Wheels.
Kuschall Champion Owners Manual, Chapter 6: Adjustments carried out by the Authorized Dealer.
Kuschall Ultralight Owners Manual, Chapter 6: Adjustments carried out by the Authorized Dealer.
Ottobock Avantegarde Owners Manual, Chapter 12: Adjustability/Assembly Instructions and Chapter 15: Technical Data.
Sunrise Medical, Quickie GT Owners Manual, Chapter IX: Set-up and Adjustments.
Sunrise Medical, Quickie GTX Owners Manual, Chapter IX: Set-up and Adjustments.
Sunrise Medical, Quickie LXI Owners Manual, Chapter IX: Set-up and Adjustments.
Meyra Brochure for Model X3.

* cited by examiner

*Primary Examiner* — Tony H. Winner
*Assistant Examiner* — Jacob Knutson
(74) *Attorney, Agent, or Firm* — Davis Wright Tremaine LLP; George C. Rondeau, Jr.; Heather M. Colburn

(57) ABSTRACT

A rear wheel mounting assembly for a wheelchair having a frame with upper and lower longitudinal members vertically spaced from one another and disposed along the same side of the frame. The rear wheel mounting assembly includes an elongated upright member with a plurality of spaced apart recesses arranged longitudinally along an inward face. The elongated upright member includes a clamp disposed at each of its ends. One of the clamps is clamped to the upper longitudinal frame member and the other to the lower longitudinal frame member. The rear wheel mounting assembly includes a camber clamping assembly having an aperture for receiving and retaining an axle of a rear wheel and a removable clamp having a clamping surface engaged with a portion of the elongated upright member. The clamping surface comprises a projection received within one of the recesses of the elongated upright member.

19 Claims, 9 Drawing Sheets

REAR WHEEL MOUNTING ASSEMBLY FOR A WHEELCHAIR

BACKGROUND OF THE INVENTION

1. Field of the Invention

The present invention is directed generally to a rear axle assembly for a wheelchair and more particularly to a rear axle assembly for a wheelchair that provides for vertical height adjustment of the axle of the rear wheel relative to the frame of the wheelchair.

2. Description of the Related Art

A typical wheelchair includes a seat supported by a frame resting upon four wheels. A front wheel and a rear wheel are disposed on each side of the wheelchair. The pair of rear wheels may be located under or behind the user. The front wheels are usually located in front of the user and pivot to facilitate steering. Generally, the rear wheels are mounted to opposite sides of the frame by an axle assembly. The front wheels may each be mounted to opposite sides of the frame by a bearing fork assembly.

A wheelchair may require adjustment to fit a particular user. For example, many wheelchairs allow the user to adjust the height of the seat at the rear of the wheelchair, and therefore the angle of the seat, by moving the position of the rear axles vertically relative to the frame. The ability to change the angle of the seat is important to proper positioning of the wheelchair occupant. Increasing the angle of the seat (i.e., increasing the height of the front of the seat relative to the back of the seat) allows gravity to help prevent the occupant of the wheelchair, who will likely have limited or no lower extremity function and perhaps limited trunk muscular control, from sliding out of the seat. Often, finding the correct angle of the seat is a matter of trial and error. Over time, the most desirable angle may change. For example, a particular wheelchair user may have a degenerative disease that requires increasing the angle over time. Alternatively, as people age they become more susceptible to pressure sores. By reducing the angle of the seat, it is possible to reduce the pressure on the buttocks.

Similarly, many wheelchair designs allow a user to move the rear wheels longitudinally forward and backward relative to the seat. In this manner, the rear wheels may be positioned relative to the load they bear. To self propel a wheelchair, the occupant may apply a rotational force directly to the rear wheels. Typically, each of the rear wheels of a wheelchair will include a handrim. The occupant of the wheelchair may apply a rotational force directly to each of the rear wheels by grasping each of the handrims and applying a rotational force thereto. The amount of rotational force that must be applied to self propel the wheelchair can be reduced by positioning the rear wheels longitudinally so that the axles (which are at the centers of the rear wheels) are located as close as possible to the center of gravity of the occupied wheelchair. However, as a pivot point defined by the axles is positioned closer and closer to the center of gravity, the likelihood of the chair tipping over backwards increases, thereby rendering the chair more unstable. Therefore, it may be desirable for a user to select a longitudinal position of the rear wheels that gives the user the best tradeoff between ease of rear wheel rotation and stability.

The tradeoff selected by a particular user may be influenced by their experience level. For example, a novice unfamiliar with operating a wheelchair may prefer increased stability. However, an expert at operating the wheelchair may have little difficulty with a decreased level of stability. As a user becomes more expert at operating a wheelchair, he/she may reposition the rear wheels to achieve a more desirable tradeoff.

Consequently, the axle assemblies included with many wheelchair designs allow for vertical and/or longitudinal adjustments. In prior art designs, the vertical adjustment is typically achieved by drilling multiple through-holes into two vertical tubular frame members. A horizontal axle plate may then be fastened to the frame at the location of these through-holes by pins or other fasteners extending through one of the through-holes. The rear wheels are fastened to the axle plates, which typically have multiple through-holes to permit longitudinal adjustment of the rear axle position as well as the vertical adjustment provided by the through-holes in the vertical tubular frame members.

This method has several drawbacks. First, the vertical frame members are weakened by the through-holes drilled therein. In some designs, an additional vertical member is required to help bear the load. The additional vertical member may increase the weight of the chair. Second, drilling the through-holes is an additional processing step that adds expense to the manufacture of the wheelchair. Third, the load bearing requirements placed on the vertical frame members limits the minimum distance between the through-holes. If the through-holes are too close together, the material between the through-holes may not support the load of the wheelchair transferred to the rear wheel axles. This limitation may determine the number of possible height adjustment options available to a user. Finally, the through-holes are generally visible to the user and detract from the visual appeal of the wheelchair.

In another prior art design, the vertical adjustment is typically achieved by fastening a vertically oriented axle plate to the frame. The axle plate has multiple through-holes that permit the rear wheels to be fastened to the axle plate at varying heights. The vertical axle plate can be repositioned longitudinally along the frame thereby providing horizontal adjustment of the rear axle position as well as the vertical adjustment provided by the through-holes in the axle plate.

This method also has several drawbacks. First, the vertical axle plates are weakened by the through-holes drilled therein. Second, drilling the through-holes is an additional processing step that adds expense to the manufacture of the wheelchair. Third, the load bearing requirements placed on the vertical axle plates limits the minimum distance between the through-holes. If the through-holes are too close together, the material between the through-holes may not support the load of the wheelchair transferred to the rear wheel axles. This limitation may determine the number of possible height adjustment options available to a user. Finally, the through-holes are generally visible to the user and detract from the visual appeal of the wheelchair.

Therefore, a need exists for wheelchair designs with more rear seat height adjustment options. A further need exists for a rear wheel mounting assembly that allows for height adjustment without the use of through-holes drilled through load-bearing frame members or vertical axle plates.

BRIEF DESCRIPTION OF THE SEVERAL VIEWS OF THE DRAWING(S)

DETAILED DESCRIPTION OF THE INVENTION

Figure 1:
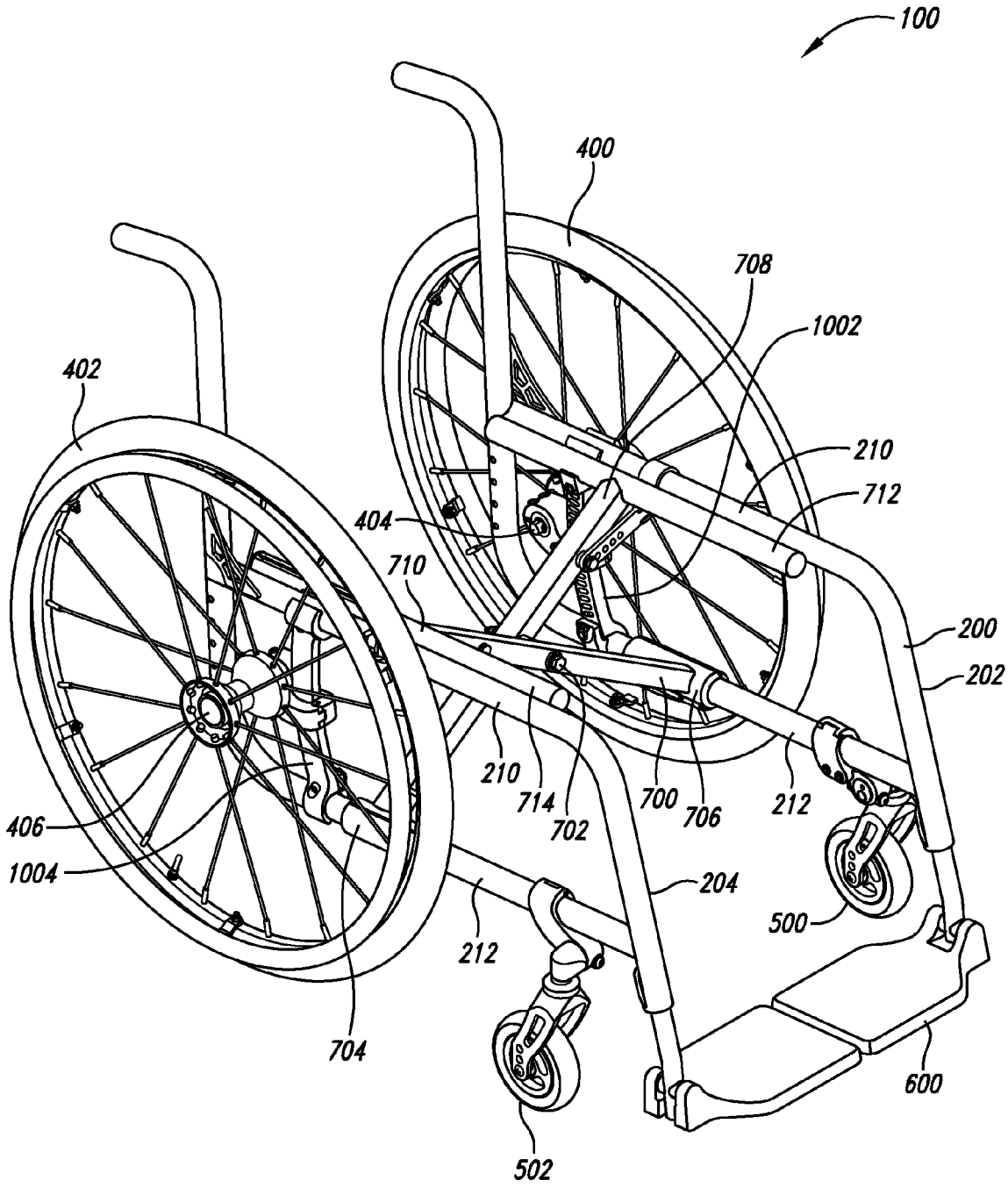
FIG. 1 is a perspective view of an exemplary wheelchair incorporating a rear wheel mounting assembly constructed in accordance with the present invention. The seat has been removed from the wheelchair to provide a better view of aspects of the invention.

Throughout this application, the term "camber" is used to describe various components related to coupling rear wheels to the frame of a wheelchair. While the term "camber" may refer in other contexts to the outward or inward tilt of a wheel (a negative cambering existing when the top of the wheel is tilted outwardly (away from a person sitting in the wheelchair) and positive cambering existing when the top of the wheel tilts inwardly (toward a person sitting in the wheelchair)), as used herein the term does not describe any particular tilt with respect to the rear wheels of a wheelchair. The typical camber of the rear wheels of a wheelchair may include 0°, 2°, 4°, 6°, and 8° and such embodiments are within the scope of the present invention. Further, as will be apparent to those of ordinary skill, the present invention may be used to mount rear wheels having zero camber or any degree of camber to a wheelchair and the invention is not limited to any particular rear wheel camber.

Aspects of the present invention are directed toward a rear wheel mounting assembly for use with a wheelchair. While an exemplary wheelchair 100 is provided in FIG. 1 for illustrative purposes, it is understood by those of ordinary skill in the art that alternate embodiments of wheelchair 100 are within the scope of the present invention. While a typical wheelchair, such as wheelchair 100, includes numerous components, only components relevant to the invention will be described herein. Further, the seat of the wheelchair 100 has been removed from the drawings to provide a better view of the present invention.

The wheelchair 100 includes a generally tubular frame 200 with a left side 202 and a right side 204 as perceived by an occupant of the wheelchair 100. Along both the left side 202 and the right side 204, the frame 200 has a generally horizontally extending upper longitudinal member 210 and a generally horizontally extending lower longitudinal member 212. In one embodiment, the upper and lower longitudinal members 210 and 212 may be substantially parallel. In this manner, the vertical distance between the upper and lower longitudinal members 210 and 212 may remain substantially constant along the longitudinal axis of the upper and lower longitudinal members 210 and 212.

While in the embodiment depicted in the drawings, the upper and lower longitudinal members 210 and 212 have a generally circular cross-sectional shape, it is appreciated by those of ordinary skill in the art that the upper and lower longitudinal members 212 may have alternate cross-sectional shapes, including oval, square, rectangular, triangular, and the like. Further, the cross-sectional shape of the upper and lower longitudinal members 210 and 212 may change over their length. For example, a portion of the lower longitudinal member 210 adjacent to one of the rear wheels 400 and 402 may have a generally circular cross-sectional shape and a portion of the lower longitudinal member 210 adjacent to one of the front wheels 500 and 502 may have a generally oval cross-sectional shape.

The wheelchair 100 may also include a left front wheel 500 attached to the left side of the frame 200 and a right front wheel 502 attached to the right side of the frame 200. In one embodiment, the left front wheel 500 is attached to the lower longitudinal member 212 on the left side 202 of the wheelchair 100 and the right front wheel 502 is attached to the lower longitudinal member 212 on the right side 204 of the wheelchair 100.

In embodiments of the wheelchair 100 that fold, the wheelchair 100 may include cross-tubes 700 coupled between the upper and lower longitudinal members 210 and 212 of the left side 202 and the upper and lower longitudinal members 210 and 212 of the right side 204. The cross-tubes 700 may be attached to each other and pivot relative to one another about a pivot pin 702. A first lower portion 704 of the cross-tubes 700 may be clamped to the lower longitudinal member 212 on the left side 202 of the wheelchair 100 and a second lower portion 706 of the cross-tubes 700 may be clamped to the lower longitudinal member 212 on the right side 204 of the wheelchair 100. First and second upper portions 708 and 710 of the cross-tubes 700 may each include a longitudinally extending seat support member 712 and 714, respectively. The longitudinally extending seat support member 712 and 714 may extend along and be generally parallel to a portion of the upper longitudinal members 210 of the left and right sides 202 and 204, respectively, of the frame 100.

The wheelchair 100 may include a seat (not shown) that is coupled to each of the seat support members 712 and 714 of the cross-tubes 700 and extends therebetween. If the wheelchair 100 does not include the cross-tubes 700, the seat may be coupled to the frame 200. In one embodiment, the seat may be coupled to the upper longitudinal members 210 of both the left and right sides 202 and 204, and extend therebetween. Optionally, a footrest 600 may be coupled to the frame 200 in any manner known in the art.

The wheelchair 100 also includes a left rear wheel 400 coupled to the left side 202 of the frame 200 and a right rear wheel 402 coupled to the right side 204 of the frame 200. The rear wheels 400 and 402 are coupled to the frame 200 by, and rotate about, rear axles 404 and 406, respectively. The rear axles 404 and 406 may be received into rear wheel mounting assemblies 1002 and 1004, respectively.

Figure 3:
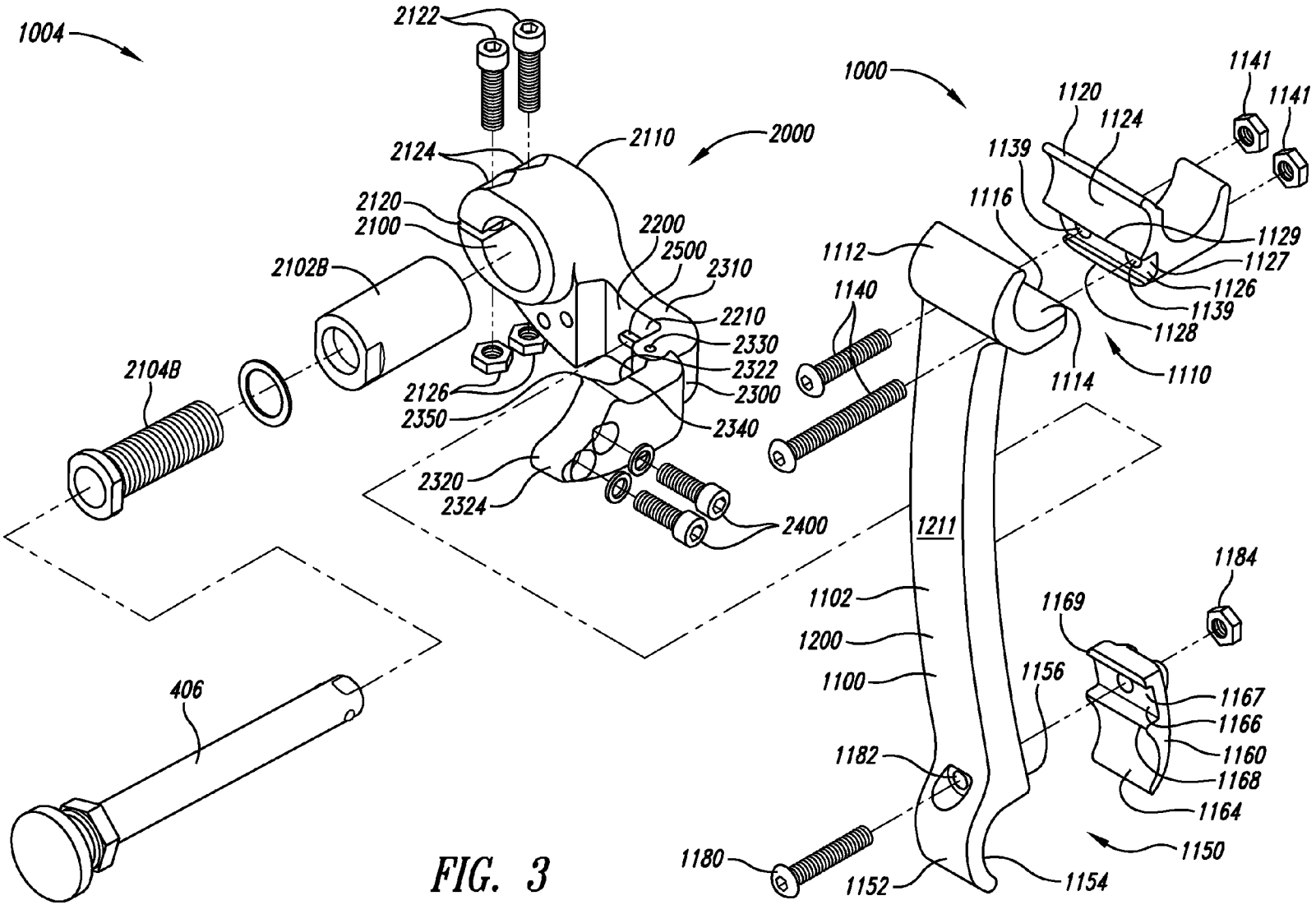
FIG. 3 is an enlarged exploded perspective view of the rear wheel mounting assembly of the wheelchair of FIG. 1.
Figure 7:
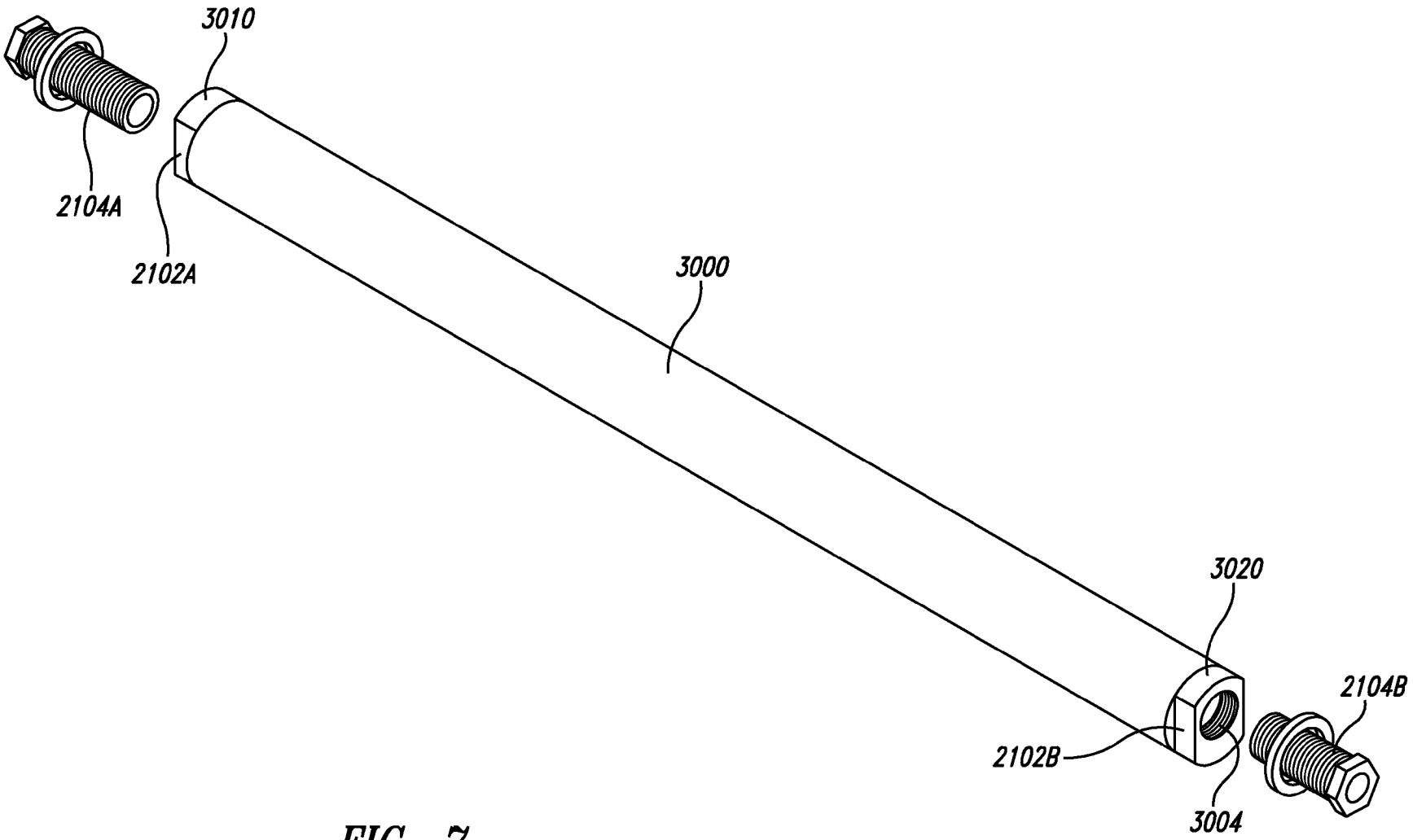
FIG. 7 is a perspective view of a camber tube, including the camber plug and axle sleeves configured for use with a rear wheel mounting assembly constructed in accordance with the present invention.

As is apparent to one of ordinary skill, the rear axles 404 and 406 may be received into axle sleeves 2104A and 2104B, respectively (see FIGS. 3 and 7). In turn, the axle sleeves 2104A and 2104B may be installed into camber plugs 2102A and 2102B, respectively (see FIGS. 3 and 7).

In folding embodiments of wheelchair 100, the camber plug 2102A may be installed into the rear wheel mounting assembly 1002 and the camber plug 2102B may be installed into the rear wheel mounting assembly 1004. In embodiments of wheelchair 100 that do not fold, the wheelchair 100 may include a camber tube, such as a camber tube 3000 (see FIG. 7), expandable or adjustable length camber tube 3000' (see FIG. 8), and the like. The camber tubes 3000 and 3000' may each include a first end 3010 and a second end 3020. Each of the first and second ends 3010 and 3020 may include an opening (not shown) into which one of the camber plugs 2102A and 2102B, respectively, may be installed. The first and second ends 3010 and 3020 of one of the camber tubes 3000 and 3000' may be received into the rear wheel mounting assemblies 1002 and 1004, respectively.

The rear wheel mounting assemblies 1002 and 1004 each mount one of the rear wheels 400 and 402, respectively, to the wheelchair 100. As is appreciated by one of ordinary skill in the art, the left and right rear wheel mounting assemblies 1002 and 1004 may be substantially identical or mirror images of one another. For this reason, only the right rear wheel mounting assembly 1004 will be described in detail.

The right rear wheel mounting assembly 1004 may include a camber mounting assembly 1000 clamped to the frame 200 and a camber clamping assembly 2000 clamped to the camber mounting assembly 1000.

Figure 2:
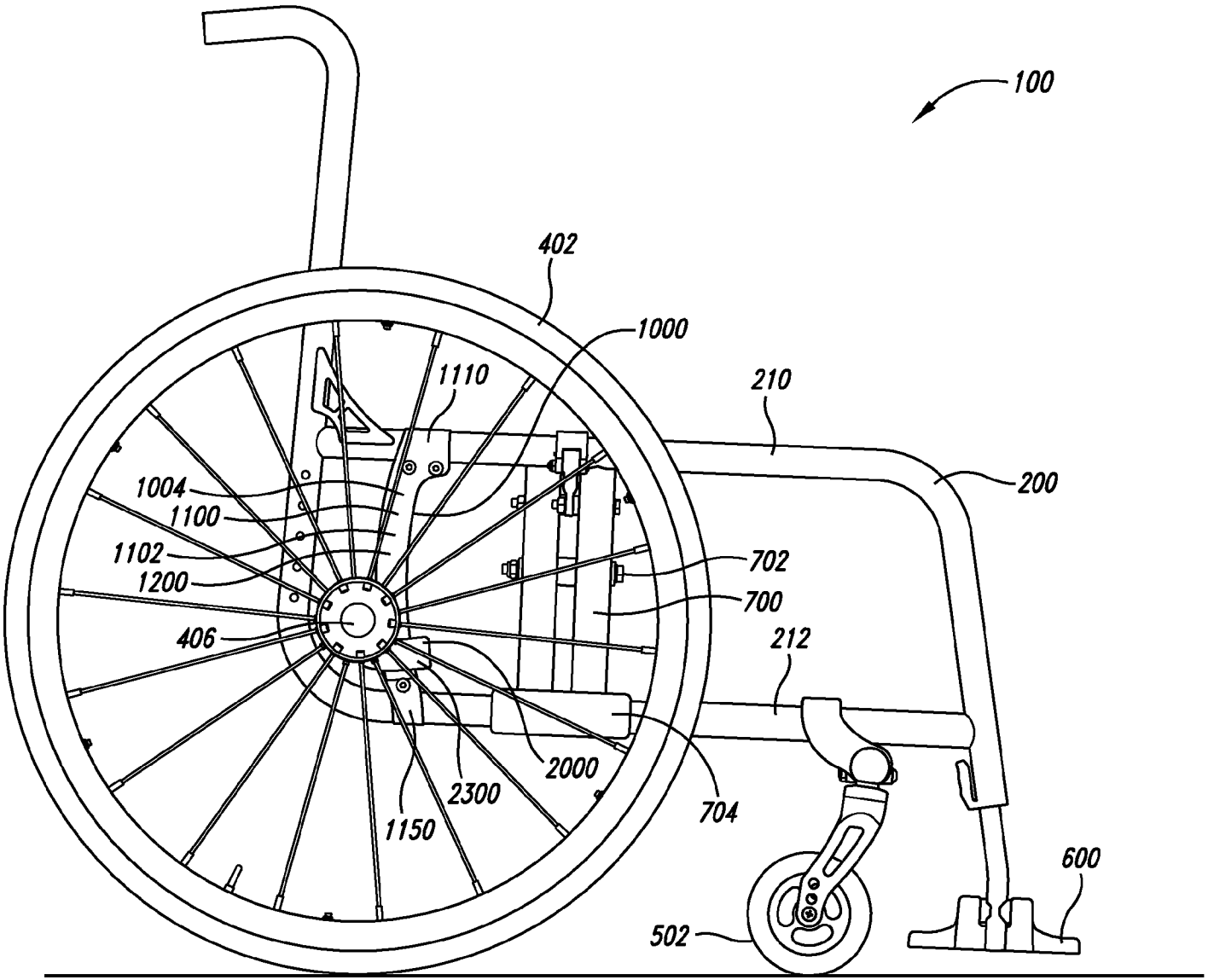
FIG. 2 is a side view of the wheelchair of FIG. 1 in which an upper clamp and a lower clamp of a rear wheel mounting assembly are located in a first exemplary longitudinal position and a camber clamping assembly of the rear wheel mounting assembly is located in a first exemplary vertical position.

Referring to FIG. 2, the camber mounting assembly 1000 may include an axle plate or elongated upright member 1100, an upper clamp 1110, and a lower clamp 1150. The elongated upright member 1100 may be disposed generally vertically between the upper longitudinal member 210 and the lower longitudinal member 212 and may be coupled to the upper longitudinal member 210 by the upper clamp 1110, and coupled to the lower longitudinal member 212 by the lower clamp 1150.

The upper clamp 1110 may be constructed using any clamp known in the art for attaching the rear wheel mounting assembly 1004 to the frame 200 of the wheelchair 100. In the illustrated embodiment of FIG. 3, the upper clamp 1110 includes a first clamp portion 1112 integrally formed with an upper end of the elongated upright member 1100. The first clamp portion 1112 may be configured to receive a portion of the upper longitudinal member 210. For example, in some embodiments the upper longitudinal member 210 may have a generally cylindrical shape with a circular cross-sectional shape. In an alternate embodiment, the upper longitudinal member 210 may have a generally oval cross-sectional shape. With respect to such embodiments, the first clamp portion 1112 may have an inside surface 1114 with a contour configured to conform to a portion of the outside surface of the upper longitudinal member 210 received therein. In this manner, the first clamp portion 1112 may mate with and/or cradle a portion of the upper longitudinal member 210.

The upper clamp 1110 may also include a second clamp portion 1120. The second clamp portion 1120 may be configured to receive a portion of the upper longitudinal member 210. For example, in some embodiments the upper longitudinal member 210 may have a generally cylindrical shape with a circular cross-sectional shape. In an alternate embodiment, the upper longitudinal member 210 may have a generally oval cross-sectional shape. With respect to such embodiments, the second clamp portion 1120 may have an inside surface 1124 with a contour configured to conform to a portion of the outside surface of the upper longitudinal member 210 received therein. In this manner, the second clamp portion 1120 may mate with and/or cradle a portion of the upper longitudinal member 210. The first and second clamp portions 1112 and 1120, which assemble to form the upper clamp 1110, may be used to securely clamp the upper longitudinal member 210 therebetween at a desired location along the upper longitudinal member.

Figure 4:
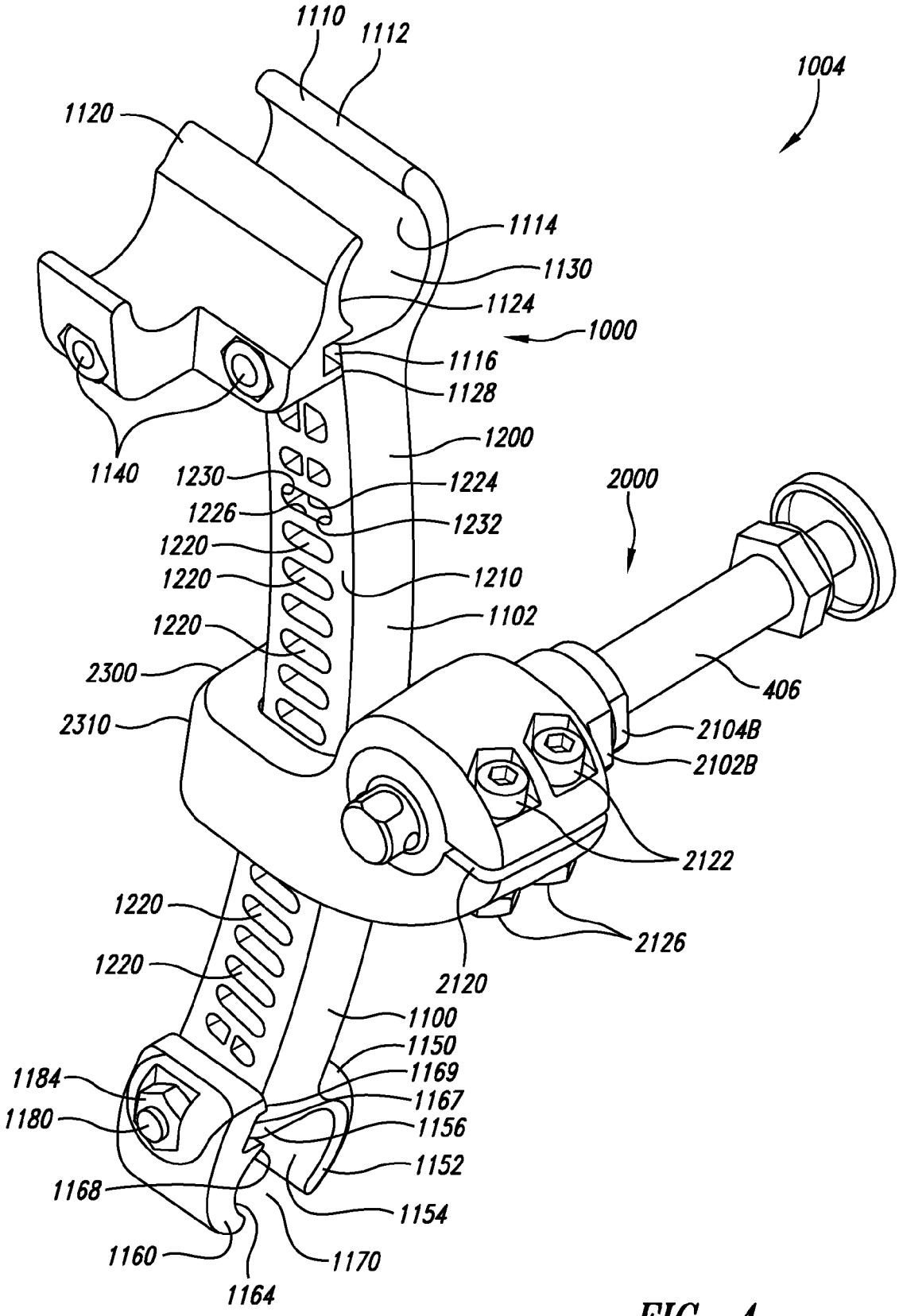
FIG. 4 is a perspective view of the rear wheel mounting assembly of FIG. 3.

Referring to FIGS. 3 and 4, the second clamp portion 1120 may be configured to abut a portion of the elongated upright member 1100 and/or a portion of the first clamp portion 1112. One or more fasteners 1140 may be used to secure the first clamp portion 1112 and the second clamp portion 1120 together. The fasteners 1140 may include bolts, screws, and the like. Referring to FIG. 4, a channel 1130 may be defined between the first clamp portion 1112 and the second clamp portion 1120 when assembled together.

In particular embodiments, the second clamp portion 1120 includes an elongated surface 1126 including a recess 1127 having a lower sidewall 1128 and an upper sidewall 1129. The lower sidewall 1128 may be configured to abut a portion 1116 of the elongated upright member 1100 located below the upper clamp portion 1112. The upper sidewall 1129 may extend away from the elongated surface 1126 into the channel 1130 and toward the first clamp portion 1112. In various embodiments, the upper sidewall 1129 may extend outwardly away from the elongated surface 1126 further than the lower sidewall 1128.

In the embodiment depicted in FIG. 3, the fasteners 1140 include bolts disposed within through-holes 1139 that extend through both the first and second clamp portions 1112 and 1120 and retained by nuts 1141. The through-holes may pass through the portion 1116 of the first clamp portion 1112 adjacent to the elongated surface 1126 of the second clamp portion 1120.

The fasteners 1140 are used to increase or decrease the cross-sectional area of the channel 1130 by increasing or decreasing the distance between the first and second clamp portions 1112 and 1120. In this manner, the amount of clamping pressure applied to the upper longitudinal member 210 by the upper clamp 1110 may be adjusted. For example, tightening the fasteners 1140 may force the second clamp portion 1120 to pivot about the portion of the lower sidewall 1128 abutting the portion 1116 of the elongated upright member 1100 advancing the second clamp portion 1120 into the channel 1130 and toward the first clamp portion 1112, reducing the cross-sectional area of the channel 1130.

In one embodiment, the channel 1130 is defined between the inside surface 1114 of the first clamp portion 1112 and the inside surface 1124 of the second clamp portion 1120. The channel 1130 is configured to receive a portion of the upper longitudinal member 210 and allows the upper longitudinal member 210 to pass between the first and second clamp portion 1112 and 1120.

If the pressure is reduced below a predetermined threshold, the first and second clamp portions 1112 and 1120 may adjustably slide along the upper longitudinal member 210 to a new longitudinal position whereat an adequate clamping pressure may be applied to prevent further movement of the upper clamp 1110 during use of the wheelchair 100. The upper clamp 1110 may be positioned at any selected location along the upper longitudinal member 210 by sliding the loosened first and second clamp portion 1112 and 1120 along the upper longitudinal member 210 to provide infinite adjustability.

The lower clamp 1150 may include any clamp known in the art for attaching the rear wheel mounting assembly 1004 to the frame 200 of the wheelchair 100 including a clamp constructed in accordance with the upper clamp 1110. In the illustrated embodiment of FIG. 3, the lower clamp 1150 includes a first clamp portion 1152 integrally formed on the opposite end of the elongated upright member 1100 from the first clamp portion 1112 of the upper clamp 1110. The first clamp portion 1152 may be configured to receive a portion of the lower longitudinal member 212. For example, in some embodiments the lower longitudinal member 212 may have a generally cylindrical shape with a circular cross-sectional shape. In alternate embodiments, the lower longitudinal member 212 may have a generally oval cross-sectional shape. With respect to such embodiments, the first clamp portion 1152 may have an inside surface 1154 with a contour configured to conform to a portion of the outside surface of the lower longitudinal member 212 received therein. In this manner, the first clamp portion 1152 may mate with and/or cradle a portion of the lower longitudinal member 212. In one embodiment, a portion of the inside surface 1154 rests upon a portion of the upper surface of the lower longitudinal member 212 and transfers a portion of the vertical load applied to the elongated upright member 1100 to the lower longitudinal member 212.

The lower clamp 1150 may also include a second clamp portion 1160. The second clamp portion 1160 may be configured to receive a portion of the lower longitudinal member 212. In an embodiment wherein the lower longitudinal member 212 has a generally cylindrical shape, the second clamp portion 1160 may have an inside surface 1164 with a contour configured to conform to a portion of the outside surface of the lower longitudinal member 212 received therein. In this manner, the second clamp portion 1160 may mate with and/or cradle a portion of the lower longitudinal member 212. The first and second clamp portions 1152 and 1160, which assemble to form the lower clamp 1150, may be used to securely clamp the lower longitudinal member 212 therebetween at a desired location along the lower longitudinal member.

Referring to FIGS. 3 and 4, the second clamp portion 1160 may be configured to abut a portion of the elongated upright member 1100 and/or a portion 1156 of the first clamp portion 1152. One or more fasteners 1180 may be used to secure the first clamp portion 1152 and the second clamp portion 1160 together. The fasteners 1180 may include bolts, screws, and the like. Referring to FIG. 4, a channel 1170 is defined between the first clamp portion 1152 and the second clamp portion 1160 when assembled together.

In particular embodiments, the second clamp portion 1160 includes an elongated surface 1166 including a recess 1167 having a lower sidewall 1168 and an upper sidewall 1169. The upper sidewall 1169 may be configured to abut a portion 1156 of the elongated upright member 1100 located above the lower clamp portion 1152. The lower sidewall 1168 may extend away from the elongated surface 1166 into the channel 1170 and toward the first clamp portion 1152. In various embodiments, the lower sidewall 1168 may extend outwardly away from the elongated surface 1166 further than the upper sidewall 1169.

In the embodiment depicted in FIG. 3, a single fastener 1180 is used and includes a bolt disposed within a through-hole 1182 that extends through both the first and second clamp portions 1152 and 1160 and retained by a nut 1184. The through-hole 1182 may pass through the portion 1156 of the first clamp portion 1152 adjacent to the surface 1166 of the second clamp portion 1160.

In one embodiment, the channel 1170 is defined between the inside surface 1154 of the first clamp portion 1152 and the inside surface 1164 of the second clamp portion 1160. The channel 1170 may be configured to receive a portion of the lower longitudinal member 212 and allows the lower longitudinal member 212 to pass between the first and second clamp portions 1152 and 1160.

The fastener 1180 may be used to increase or decrease the cross-sectional area of the channel 1170 by increasing or decreasing the distance between the first and second clamp portions 1152 and 1160. In this manner, the amount of clamping pressure applied to the lower longitudinal member 212 by the lower clamp 1150 may be adjusted. For example, tightening the fastener 1180 may force the second clamp portion 1160 to pivot about the portion of the lower sidewall 1168 abutting the portion 1156 of the elongated upright member 1100 advancing the second clamp portion 1160 into the channel 1170 and toward the first clamp portion 1152, reducing the cross-sectional area of the channel 1170.

If the pressure is reduced below a predetermined threshold, the first and second clamp portions 1152 and 1160 may adjustably slide along the lower longitudinal member 212 to a new longitudinal position whereat an adequate clamping pressure may be applied to prevent further movement of the lower clamp 1150 during use of the wheelchair 100. The lower clamp 1150 may be positioned at any selected location along the lower longitudinal member 212 by sliding the loosened first and second clamp portions 1152 and 1160 along the lower longitudinal member 212 to provide infinite adjustability.

Figure 5:
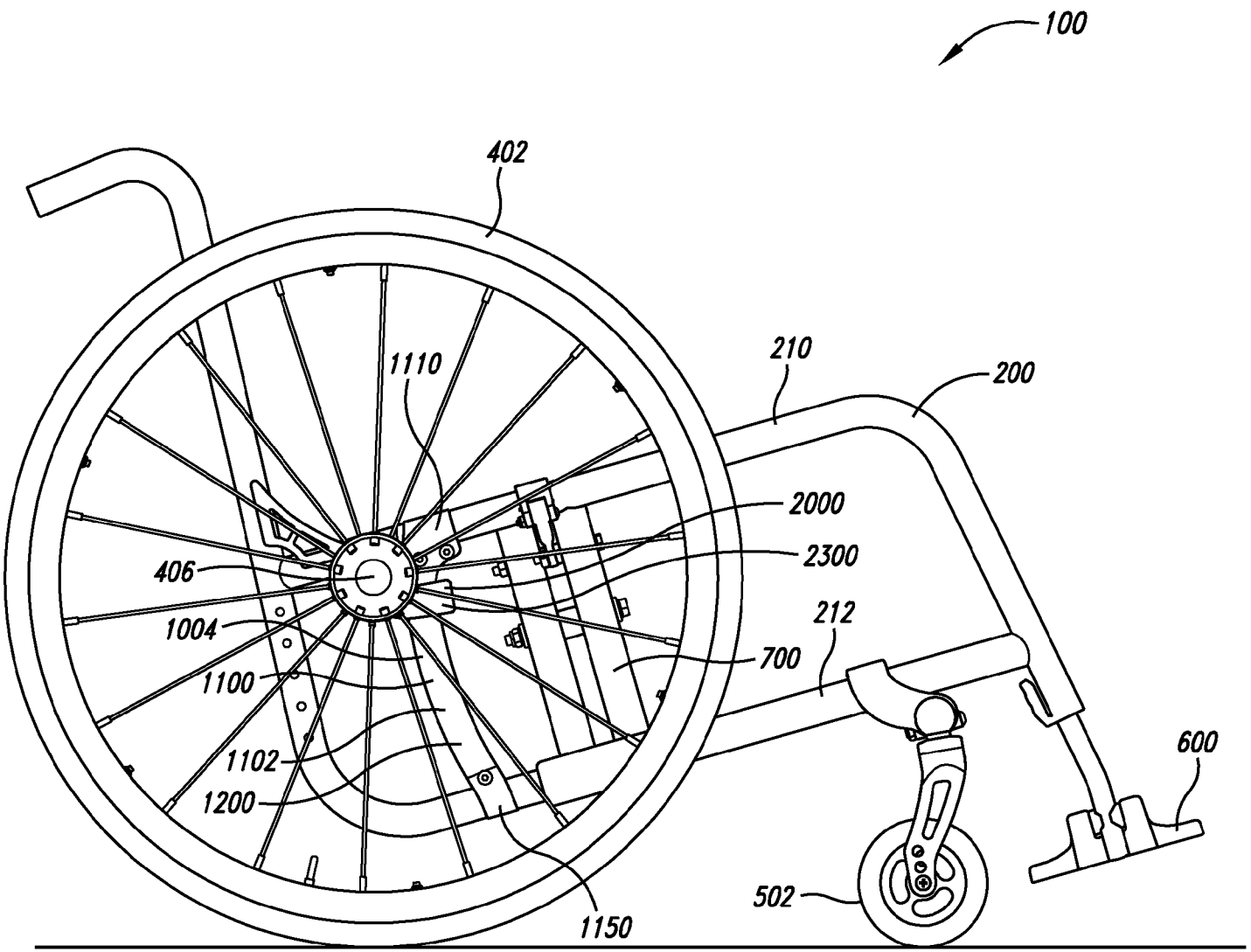
FIG. 5 is a side view of the wheelchair of FIG. 1 in which the upper and lower clamps of the rear wheel mounting assembly are located in a second exemplary longitudinal position and the camber clamping assembly of the rear wheel mounting assembly is located in a second exemplary vertical position

If the amount of clamping pressure applied to the upper and lower longitudinal members 210 and 212 is reduced below a predetermined threshold, both the upper and lower clamps 1110 and 1150 may be slid relative to the upper and lower longitudinal members 210 and 212 at the same time. In this manner, the longitudinal position of the rear wheel mounting assembly 1004 and hence the right rear wheel 402 may be adjusted forward and rearward relative to the frame 200. FIGS. 2 and 5 show two exemplary longitudinal positions of the upper and lower clamps 1110 and 1150. FIG. 2 illustrates the upper and lower clamps 1110 and 1150 in one rearward position relative to the frame 200. As is apparent to those of ordinary skill in the art, the position of the upper and lower clamps 1110 and 1150 illustrated in FIG. 2 is not necessarily the most rearward position. In contrast, FIG. 5 illustrates the upper and lower clamps 1110 and 1150 in a more forward position relative to the frame 200. As is apparent to those of ordinary skill in the art, the position of the upper and lower clamps 1110 and 1150 illustrated in FIG. 2 is not necessarily the most forward position. In one embodiment, the upper and lower clamps 1110 and 1150 may be slid from the position illustrated in FIG. 2 to the position illustrated in FIG. 5 and vise versa. Further, the upper and lower clamps 1110 and 1150 may be slid into any position between those illustrated in FIGS. 2 and 5.

Referring to FIG. 2, the elongated upright member 1100 extends between the upper longitudinal member 210 and the lower longitudinal member 212 in an orientation that may be substantially perpendicular to the upper and lower longitudinal members 210 and 212. It is apparent to those of ordinary skill in the art that the elongated upright member 1100 may include a curved or arcuate portion 1102 and can be at other than a substantially orthogonal angle relative to the upper and lower longitudinal members 210 and 212. Because the elongated upright member 1100 is a load bearing member, its shape and size may be determined based upon the load to be applied thereto.

The elongated upright member 1100 may include a body portion 1200 disposed between the upper and lower first clamp portions 1112 and 1152. It is appreciated by those of ordinary skill in the art that the size and shape of the components related to the present invention depend upon many factors, including the size of the intended occupant of the wheelchair 100 and the distance between the upper and lower longitudinal members 210 and 212. In various embodiments, the height of the body portion 1200 of the elongated upright member 1100 ranges from about 5 inches to about 9 inches, the width of the body portion 1200 ranges from about 0.75 inches to about 1.25 inches, and the thickness of the body portion 1200 may range from about 0.4 inches to about 1.0 inches. In various embodiments, the height of the body portion 1200 of the elongated upright member 1100 is about 5.1 inches, the width of the body portion 1200 is about 1 inch, and the thickness of the body portion 1200 is about 0.7 inches. The thickness of the body portion 1200 may increase as it approaches the clamping portions 1112 and 1152.

The upper first clamp portion 1112 of the elongated upright member 1100 may have a height ranging from about 1.5 inches to about 2.0 inches and a width ranging from about 1.25 inches to about 2.15 inches. In various embodiments, the height of the upper first clamp portion 1112 is about 1.75 inches and the width of the upper first clamp portion 1112 is about 1.5 inches near the top of the upper clamp 1110 and about 1.85 inches at its widest point.

The lower first clamp portion 1152 may have a height of about 1.5 inches to about 2.0 inches and a width of about 0.75 inches to about 1.25 inches. In various embodiments, the height of the lower first clamp portion 1152 is about 1.75 inches and its width is about 1.0 inches.

Referring to FIG. 4, the body portion 1200 of the elongated upright member 1100 may have an inwardly facing outside surface 1210 including a plurality of vertically arranged height adjustment recesses 1220. In particular embodiments, the recesses 1220 are spaced apart from one another vertically. In one embodiment, the recesses 1220 are spaced from one another along the longitudinal axis of the elongated upright member 1100. The vertical distance between adjacent recesses may range from about 0.1 inches to about 0.3 inches. In one embodiment, the vertical distance between adjacent recesses 1220 is about 1.4 inches. In various embodiments, each of the recesses 1220 may be about 0.25 inches to about 0.75 inches long, about 0.1 inches to about 0.3 inches wide, and about 0.2 inches to about 0.6 inches deep. In various embodiments, each of the recesses 1220 may be about 0.49 inches to about 0.5 inches long, about 0.185 inches wide, and about 0.43 inches to about 0.45 inches deep. In various embodiments, the distance between the centers of the recesses 1220 may be about 0.375 inches. In such embodiments, the height of the rear portion of the seat may be adjusted in increments of about 0.375 inches. In some embodiments, the distance between surface 1114 and surface 1154 is about 7.5 inches and the recesses 1220 extend about 5.1 inches along the body portion 1200.

In an alternate embodiment, vertical distance between adjacent recesses 1220 is about 0.05 inches and the center-line-to-center-line distance is about 0.25 inches. In this manner, the height of the rear portion of the seat may be adjusted in increments of about 0.25 inches.

While the recesses 1220 depicted in the drawings have a generally elongated cross-sectional shape defined by an open end, a generally planar top surface 1224, a generally planar bottom surface 1226, and a pair of opposing arcuate sidewalls 1230 and 1232 extending between the top and bottom surfaces 1224 and 1226, it is appreciated by those of ordinary skill in the art that alternate cross-sectional shapes including square, rectangular, oval, round, triangular, and the like including arbitrary cross-sectional shapes may be used to construct the recesses 1220. In one embodiment, the cross-sectional shape of the recesses 1220 is generally pill-shaped. Also, while the recesses 1220 are shown as separated, they may have some portions in common but be on vertically spaced centers.

As shown in FIG. 3, the body portion 1200 of the elongated vertical member 1100 has a smooth, outwardly facing outside surface 1211 to provide an aesthetically pleasing appearance without the adjustment recesses 1220 being visible.

Referring to FIG. 3, as mentioned above, the rear wheel mounting assembly 1004 includes the camber clamping assembly 2000 configured to be clamped to the elongated upright member 1100 of the camber mounting assembly 1000. The camber clamping assembly 2000 includes a collar portion 2110 with an aperture 2100 therethrough. The aperture 2100 may be configured to receive one of the camber plug 2102A, camber plug 2102B, the end 3010 of the camber tube 3000, the end 3020 of the camber tube 3000, the end 3010 of the camber tube 3000', and the end 3020 of the camber tube 3000'.

The sidewalls of the aperture 2100 may include a cutout portion 2120. One or more fasteners 2122 may be used to determine the width of the cutout portion 2120 for the purposes of changing the cross-sectional area of the aperture 2100 and securely clamping one of the camber plug 2102A, camber plug 2102B, the end 3010 of the camber tube 3000, the end 3020 of the camber tube 3000, the end 3010 of the camber tube 3000', and the end 3020 of the camber tube 3000' within the aperture 2100. The fasteners 2122 may include one or more bolts inserted into through-holes 2124 and secured by one or more nuts 2126.

The camber clamping assembly 2000 may include an upright channel 2200. The upright channel 2200 has a bottom surface 2210 with an outwardly projecting projection 2500 extending transverse to the upright channel. The upright channel 2200 is sized and shaped to receive a portion of the body portion 1200 of the elongated upright member 1100 therein. The upright channel 2200 may include sidewalls substantially orthogonal to the bottom surface 2210 or optionally sidewalls that are tapered with respect to the bottom surface 2210. One or more tapered sidewalls may facilitate the insertion and secure retention of the elongated vertical member 1100 in the upright channel 2200. The upright channel 2200 may be slightly wider than the width of the body portion 1200 of the elongated vertical member 1100.

The projection 2500 is sized and shaped to be received snugly into one of the recesses 1220 of the body portion 1200 of the elongated vertical member 1110 and prevent vertical movement of the body portion in the upright channel 2200 during use of the wheelchair 100. In various embodiments, the projection 2500 may extend about 0.05 inches to about 0.11 inches from the bottom surface 2210. In one embodiment, the projection 2500 may extend about 0.085 inches from the bottom surface 2210. The projection 2500 may be about 0.36 inches to about 0.48 inches long and about 0.14 inches to about 0.2 inches wide. In one embodiment, the projection 2500 is about 0.44 inches long and about 0.17 inches wide.

The camber clamping assembly 2000 may also include a clamp 2300. The clamp 2300 includes a base portion 2310 in which the upright channel 2200 is formed and a clamping member 2320. In the embodiment depicted in the drawings, the clamping member 2320 is pivotally attached to the base portion 2310 by a pivot pin 2330. The clamping member 2320 may pivot about the pivot pin 2330 forming a swingable attachment to the base portion 2310 of the camber clamping assembly 2000. The clamping member 2320 may be positioned so that when it is swung toward the base portion 2310 into a closed position, the body portion 1200 of the elongated vertical member 1100 positioned in the upright channel 2200 is clamped between a clamping surface 2340 of the clamping member 2320 and the bottom surface 2210 of the upright channel 2200 formed in the base portion 2310.

When the clamping member 2320 is swung toward the base portion 2310 and into the closed position, the upright channel 2200 may be opposite and laterally closed by the clamping member 2320. The projection 2500 extends toward the clamping member 2320 from the bottom surface 2210 of the upright channel 2200. Optionally, an upright channel 2322 may be formed in the clamping member 2320. The upright channel 2322 may be positioned opposite the upright channel 2200 when the clamping member 2320 is swung toward the base portion 2310 and into the closed position.

The portion of the clamping surface 2340 disposed along the clamping member 2320 may include a portion of the outside surface of a ridge 2350. The ridge 2350 may increase the surface area of the clamping surface 2340 and thereby increase the friction between the clamping member 2320 and the body portion 1200 of the elongated upright member 1100. Further, the clamping member 2320 may be shaped and sized to conform to the outside surface 1210 of the body portion 1200 of the elongated vertical member 1100 to increase the surface area of the clamping surface 2340. Optionally, the clamping surface 2340 may include texture, ridges, grooves, and the like.

One or more fasteners 2400 may securely fasten a free end 2324 of the clamping member 2320 to the base portion 2310. The fasteners 2400 may prevent the clamping member 2320 from swinging or otherwise moving relative to the base portion 2310. The fasteners 2400 may include any suitable removable fastener such as bolts, screws, and the like. Alternatively, any connector known in the art may be used to attach the free end 2324 of the clamping member 2320 to the base portion 2310.

Figure 6:
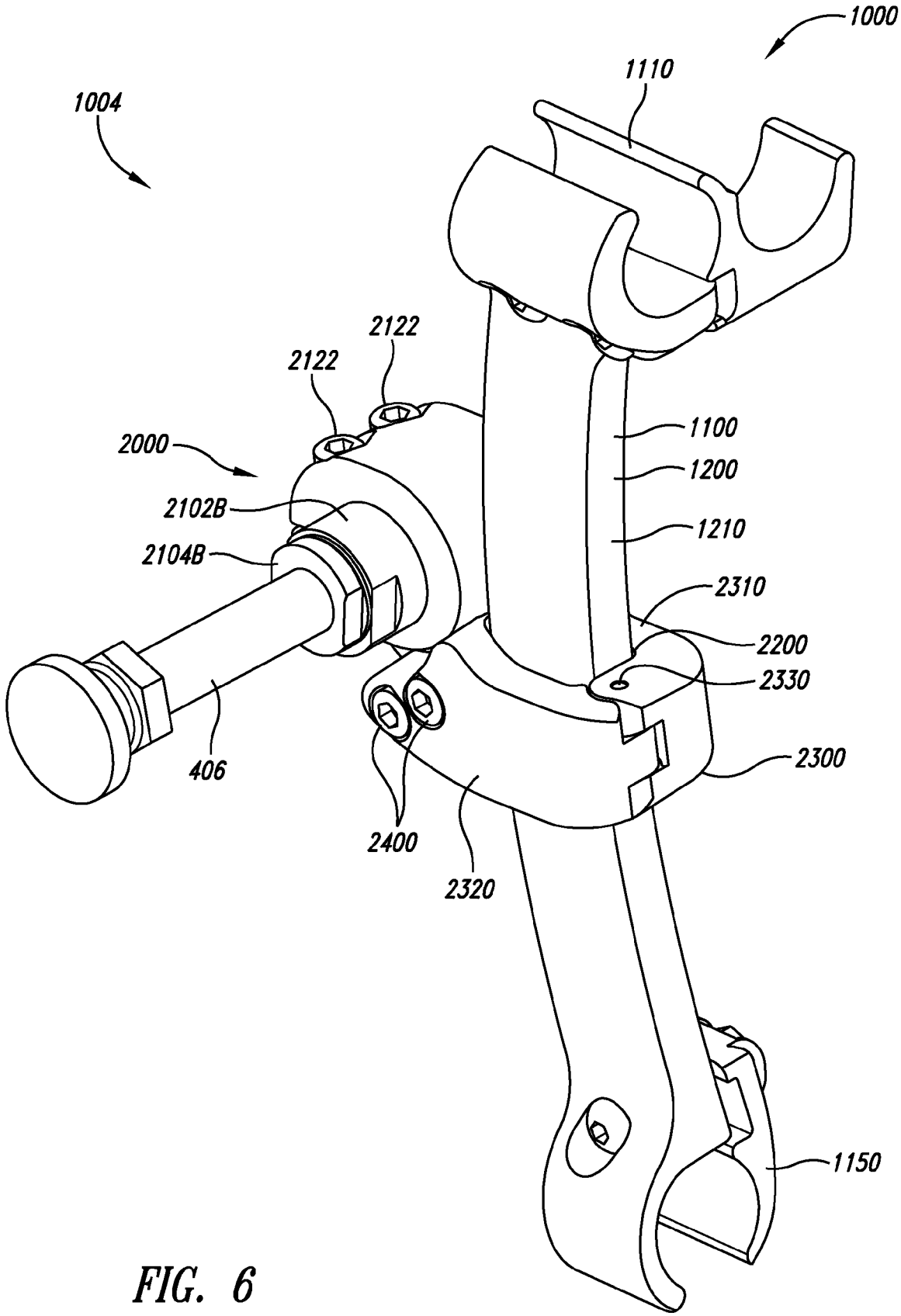
FIG. 6 is a perspective view of the rear wheel mounting assembly of FIG. 3.

Referring to FIGS. 4 and 6, when a portion of the body portion 1200 of the elongated upright member 1100 is received within the upright channel 2200 with the projection 2500 within a selected one of the recesses 1220, the clamping member 2320 may be pivoted into position adjacent to the body portion 1200 clamping the body portion 1200 between the clamping member 2320 and the bottom surface 2210 of the upright channel 2200, thus setting the height of the rear axle 406 and hence the right rear wheel 402, relative to the frame 200 of the wheelchair 100. In this manner, the height of the camber clamping assembly 2000 may be adjustably set and prevented from sliding vertically along the elongated upright member 1100 by the clamping action and the projection 2500 disposed within the selected one of the recesses 1220 during use of the wheelchair 100. The vertical position of the camber clamping assembly 2000 relative to the frame 200 is determined by the recess 1220 into which the projection 2500 is inserted. By adjusting the fasteners 2400, the clamping force exerted by the clamp 2300 on the portion of the body portion 1200 sandwiched between the clamping member 2320 and the bottom surface 2210 of the upright channel 2200 may be adjusted. The inwardly directed force of the clamp 2300 maintains the projection 2500 within the recess 1220.

While the drawings depict an embodiment having a single projection 2500 received into one of the recesses 1220, it is apparent to those of ordinary skill in the art that embodiments including more than one projection received into more than one recess are within the scope of the invention. Optionally, the projection 2500 may be placed near the center of the camber clamping assembly 2000 along the vertical axis. Alternatively, the projection 2500 may be placed off center along the vertical axis to allow a larger range of adjustment.

As is apparent to those of ordinary skill in the art, the camber mounting assembly 1000 of the left rear wheel mounting assembly 1002 may be attached to the right side 204 of the wheelchair 100. Similarly, the camber mounting assembly 1000 of the right rear wheel mounting assembly 1004 may be attached to the left side 202 of the wheelchair 100. Further, the camber clamping assembly 2000 depicted in the drawings and described as configured for use with the right rear wheel mounting assembly 1004 may be clamped to the camber mounting assembly 1000 of the left rear wheel mounting assembly 1002. As is appreciated by those of ordinary skill in the art, in embodiments wherein the left rear wheel mounting assembly 1002 is a mirror image of the right rear wheel mounting assembly 1004, at least eight unique assemblies of the camber mounting assembly 1000 and camber clamping assembly 2000 along the right side 204 of the wheelchair 100 are possible:

1) the camber clamping assembly 2000 of the right rear wheel mounting assembly 1004 clamped to the camber mounting assembly 1000 of the right rear wheel mounting assembly 1004 as depicted in FIG. 1;

2) the camber clamping assembly 2000 of the right rear wheel mounting assembly 1004 rotated 180° and clamped to the camber mounting assembly 1000 of the right rear wheel mounting assembly 1004;

3) the camber clamping assembly 2000 of the left rear wheel mounting assembly 1002 clamped to the camber mounting assembly 1000 of the right rear wheel mounting assembly 1004;

4) the camber clamping assembly 2000 of the left rear wheel mounting assembly 1002 rotated 180° and clamped to the camber mounting assembly 1000 of the right rear wheel mounting assembly 1004;

5) the camber clamping assembly 2000 of the left rear wheel mounting assembly 1002 clamped to the camber mounting assembly 1000 of the left rear wheel mounting assembly 1002;

6) the camber clamping assembly 2000 of the left rear wheel mounting assembly 1002 rotated 180° and clamped to the camber mounting assembly 1000 of the left rear wheel mounting assembly 1002;

7) the camber clamping assembly 2000 of the right rear wheel mounting assembly 1004 clamped to the camber mounting assembly 1000 of the left rear wheel mounting assembly 1002; and 8) the camber clamping assembly 2000 of the right rear wheel mounting assembly 1004 rotated 180° and clamped to the camber mounting assembly 1000 of the left rear wheel mounting assembly 1002.

Each of the above eight assemblies of the camber mounting assembly 1000 and camber clamping assembly 2000 may provide a unique range of vertical and/or horizontal rear wheel position options. In four of the eight assemblies, the camber mounting assembly 1000 of the left rear wheel mounting assembly 1002 may be rotated 180 degrees about the vertical axis and mounted to the right side 204 of the wheelchair 100. Similarly, the camber mounting assembly 1000 of the right rear wheel mounting assembly 1004 may be rotated 180 degrees about the vertical and mounted to the left side 202 of the wheelchair 100. Before clamping the camber clamping assemblies 2000 to the camber mounting assemblies 1000 clamped to the wheelchair 100 in this configuration, it may be necessary to rotate the camber clamping assemblies 2000 180 degrees about the vertical axis.

In four of the eight assemblies, the camber clamping assembly 2000 is rotated 180 degrees before it is clamped to the camber mounting assembly 1000. As is apparent to those of ordinary skill, the camber clamping assembly 2000 may be rotated about an axis substantially parallel with the ground and perpendicular to the longitudinal axis of the upper and lower longitudinal members 210 and 212. In the embodiment depicted in the drawings, rotating the camber clamping assemblies 2000 180 degrees will place the rear axles 404 and 406 closer to the front of the wheelchair 100 than the rear axle 406 would have been had the camber clamping assembly 2000 not been rotated 180 degrees. Because the rear axles 404 and 406 are closer to the front of the wheelchair 100, the rearward most longitudinal position of the camber clamping assemblies 2000 is closer to the front of the wheelchair 100 than it would have been had the camber clamping assemblies 2000 not been rotated 180 degrees. Similarly, because the rear axles 404 and 406 are closer to the front of the wheelchair 100, the forward most longitudinal position of the camber clamping assembly 2000 is closer to the front of the wheelchair 100 than it would have been had the camber clamping assembly 2000 not been rotated 180 degrees. In other words, after rotating the camber clamping assembly 2000, the rear axle 406 may be placed closer to the front of the wheelchair 100 but not as close to the back of the wheelchair 100.

Rotating the camber clamping assemblies 2000 180 degrees before attaching them to the camber mounting assembly 1000 may also affect the vertical position of the rear axles 404 and 406 relative to the frame 200 (and hence the height of the frame and seat relative to the ground). For example, rotating the camber clamping assemblies 2000 180 degrees will place the frame 200 closer to the ground than it would have been had the camber clamping assemblies 2000 not been rotated.

After the left and right axle camber clamping assemblies 2000 are rotated 180 degrees, they may be clamped to the camber mounting assembly 1000 clamped to the opposite side 204 and 202, respectively, of the wheelchair 100. In this configuration, the rear axles 404 and 406 are about as close to the front of the wheelchair 100, as the rear axles 404 and 406 would have been if they had been received into unrotated camber clamping assemblies 2000 clamped to the left and right sides of the wheelchair, respectively. However, in this configuration, the rear axles 404 and 406 may be positioned vertically lower than they could have been if the camber clamping assemblies 2000 had not been clamped to the opposite sides of the wheelchair 100.

Clamping the camber mounting member 1000 of the right rear wheel mounting assembly 1004 to the left side 202 of the wheelchair may cause any arc to traverse a different path between the upper and lower longitudinal member 210 and 212. These alternate configurations of the camber mounting assembly 1000 and camber clamping assembly 2000 make it possible to achieve a greater range of horizontal and/or vertical positions of the rear axles 404 and 406 relative to the frame.

In alternate embodiments, when the portion of the body portion 1200 of the elongated upright member 1100 is received within the upright channel 2200, the projection 2500 is received within a selected one of the recesses 1220, the clamping member 2320 is pivoted into position adjacent to the body portion 1200 enclosing the portion of the body portion 1200 within the clamp 2300 between the clamping member 2320 and the bottom surface 2210 of the upright channel 2200, a gap (not shown) may be defined between the clamp 2300 and the enclosed portion of the body portion 1200. In this manner, the height of the camber clamping assembly 2000 may be adjustably set and prevented from sliding vertically along the elongated upright member 1100 by the projection 2500 disposed within the selected one of the recesses 1220 during use of the wheelchair 100. In some embodiments, the clamp 2300 may move laterally relative to the elongated upright member 1100 when the portion of the body portion 1200 is enclosed within the clamp 2300 between the clamping member 2320 and the bottom surface 2210 of the upright channel 2200.

Referring to FIGS. 2 and 5, the height of the right rear wheel axle 406 relative to the frame 200 may be adjusted by unclamping the clamp 2300 from the elongated upright member 1100, moving the right rear wheel mounting assembly 1004 vertically to the desired position, inserting the projection 2500 into a recess 1220 at or near the desired position, and reclamping the clamp 2300 to the elongated upright member 1100. FIG. 2 illustrates the clamp 2300 clamped to a portion of the body 1200 near the lower clamp 1150. When the clamp 2300 is moved from this position to a position closer to the upper clamp 1110, the height of the axle 406 relative to the frame 200 is changed with the height of the frame being decreased relative to the ground. FIG. 5 illustrates the clamp 2300 clamped to a portion of the body portion 1200 nearer the upper clamp 1110 so as to position the frame 200 closer to the ground.

To increase the range of adjustment, the aperture 2100 may be positioned at a different vertical height than the projection 2500, e.g., the center of the aperture 2100 may be vertically offset from the projection 2500. In some embodiments, the range of adjustment may be increased by vertically offsetting the center of the aperture 2100 from the clamp 2300. The range of adjustment may be increased by simply rotating the camber clamping assembly 2000 180 degrees (as described above) before attaching it to a portion of the body portion 1200 of the elongated vertical member 1100.

The camber clamping assembly 2000 is a load-bearing member and its dimensions may be selected based upon the load exerted upon the camber clamping assembly 2000. In various embodiments, the camber clamping assembly 2000 is about 2.8 inches to about 3.8 inches long, about 2 inches to about 2.5 inches wide, and about 1 inch to about 1.5 inches thick. In one embodiment, the camber clamping assembly 2000 is about 3.3 inches long, about 2.25 inches wide, and about 1.26 inches thick. The cutout portion 2120 may be about 0.12 inches to about 0.14 inches wide. In embodiments wherein the aperture 2100 has a circular cross-sectional shape, the aperture 2100 may have a radius of about 0.4 inches to about 0.6 inches. In one embodiment, the aperture 2100 may have a radius of about 0.52 inches to accommodate generally cylindrically shaped camber plug 2102B, camber tube 3000, or camber tube 3000' each having an outside diameter of about one inch. The pivot pin 2330 may have a diameter of about 0.10 inches to about 0.14 inches. The clamping member 2320 may be about 1.2 inches to about 1.8 inches long, about 1.0 inch to about 1.4 inches wide, and about 0.3 inches to about 0.8 inches thick as measured from where the pivot pin 2330 is inserted. In one embodiment, the clamping member 2320 is about 1.4 inches long, about 1.175 inches wide, and about 0.99 inches thick as measured from where the pivot pin 2330 is inserted.

The elongated upright member 1100, the second clamp portion 1120 of the upper clamp 1110, the second clamp portion 1160 of the lower clamp 1150, the base portion 2310 of the camber clamping assembly 2000, and the clamping member 2320 of the camber clamping assembly 2000 may be constructed from any suitable material known in the art, including A360.0-F aluminum die cast alloy, 6061 T6 aluminum alloy, zinc aluminum alloys, magnesium alloys, fiber-reinforced plastics/composites, titanium alloys, and the like. In particular embodiments, the second clamp portion 1120 of the upper clamp 1110 is constructed from molded nylon-reinforced plastic.

As mentioned above and appreciated by those of ordinary skill in the art, the left and right rear wheel mounting assemblies 1002 and 1004 may be substantially identical or mirror images of one another. For this reason, the components of the left rear wheel mounting assembly 1002 may have substantially the same construction as the components described above with respect to the right rear wheel mounting assembly 1004.

Figure 8:
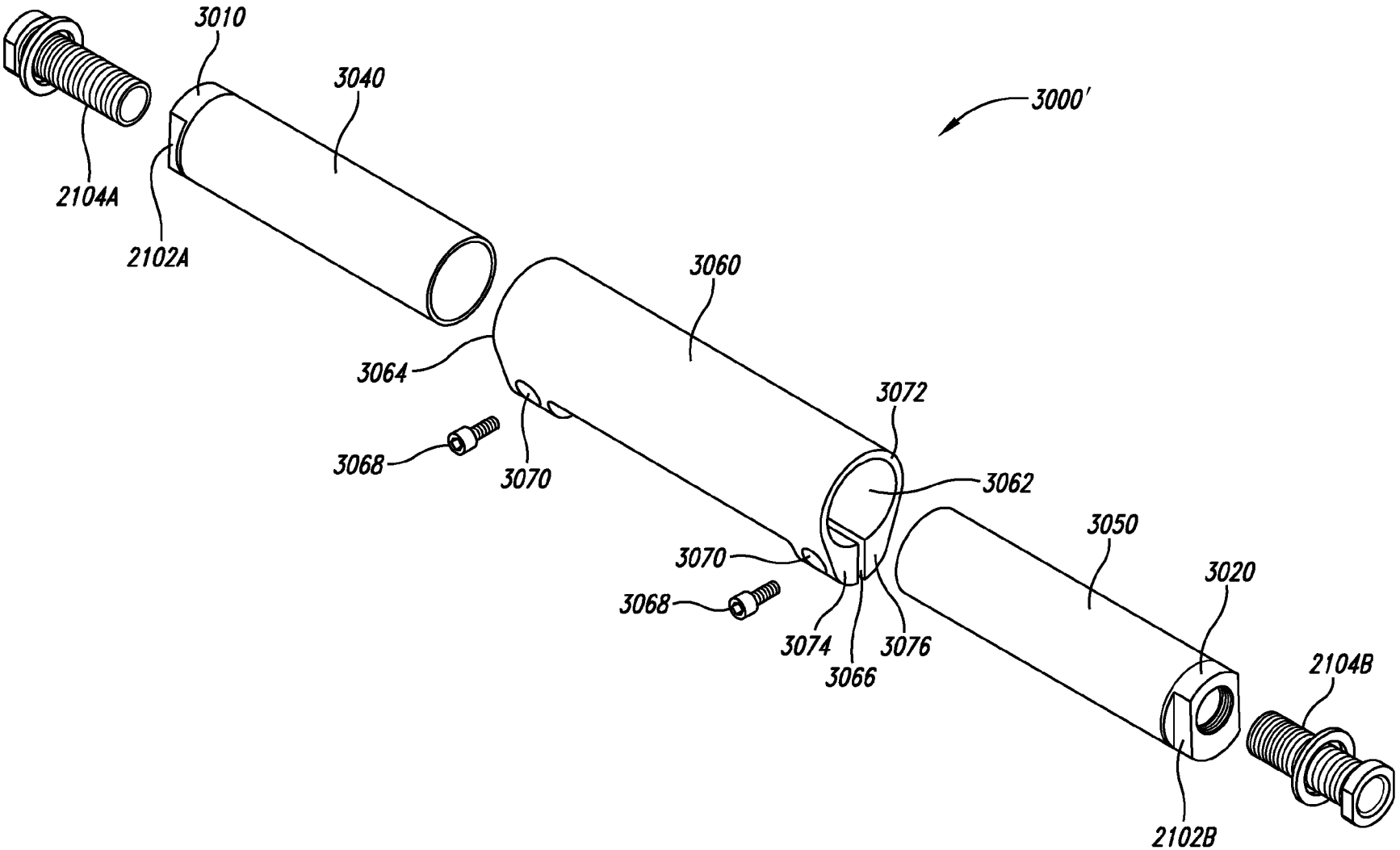
FIG. 8 is a perspective view of an adjustable length camber tube, including the camber plug and axle sleeves configured for use with a rear wheel mounting assembly constructed in accordance with the present invention.

Referring to FIGS. 7 and 8, optionally, the left and right camber clamping assemblies 2000 of the left and right rear wheel mounting assemblies 1002 and 1004, respectively, may be connected by a single camber tube 3000 or 3000'. As introduced above, each of the camber tubes 3000 and 3000' has the first and second ends 3010 and 3020, respectively. In various embodiments, the first and second camber plugs 2104A and 2104B may be connected to or integrally formed into the first and second ends 3010 and 3020, respectively. Each of the camber plugs 2104A and 2104B includes an aperture 3004 for receiving the axle sleeves 2102A and 2102B respectively, therein. The rear axles 404 and 406 may be received by the axle sleeves 2102A and 2102B respectively.

The end 3010 of one of the camber tubes 3000 and 3000' including the first camber plug 2104A may be inserted into the aperture 2100 of the camber clamping assembly 2000 mounted to the left side 202 of the wheelchair 100. The other end 3020 including the first camber plug 2104B may be inserted into the aperture 2100 of the camber clamping assembly 2000 mounted to the right side 204 of the wheelchair 100.

In this embodiment, the height of the rear wheel axles 404 and 406 may be adjusted together by unclamping the clamp 2300 from the elongated vertical member 1100 disposed along the left side 202 of the wheelchair 100 and unclamping the clamp 2300 from the elongated vertical member 1100 disposed along the right side 204 of the wheelchair 100. Next, the camber clamping assemblies 2000 may be moved vertically to a desired vertical position and the projection 2500 of each camber clamping assembly 2000 inserted into a desired one of the recess 1220 of the body portion 1200 of the elongated vertical member 1100 located on the same side of the wheelchair 100. After each projection 2500 is received into the desired recess 1220, the clamp 2300 of each of the camber clamping assemblies 2000 may be reclamped to the body portion 1200 of the elongated upright member 1100.

If the adjustable length camber tube 3000' depicted in FIG. 8 is used to connect the left and right camber clamping assemblies 2000, the distance between the left and right camber clamping assemblies 2000 may be adjusted by adjusting the length of the adjustable length camber tube 3000'. For example, the adjustable length camber tube 3000' may include a first end portion 3040 joined to a second end portion 3050 by an intervening clamping sleeve 3060. The end portions 3040 and 3050 may inserted into opposing open ends 3062 and 3064 of the sleeve 3060, respectively, and the depth of their insertion adjusted until a desired overall length of the camber tube 3000' is achieved.

The clamping sleeve 3060 may include a cutout portion 3066 the width of which may be determined by one or more fasteners 3068. The fasteners 3068 may be received into through-holes 3070 that extends through portions 3074 and 3076 of the sidewall 3072 located along opposite sides of the cut-out portion 3066 and transversely across the cut-out portion 3066. A portion of the through-hole 3070 extending through one of the portions 3074 and 3076 of the sidewall 3072 may include threading configured to mate with threads disposed along the outside surface of the fastener 3068. The fastener 3068 may be used to determine the width of the cutout portion 3066 at the ends 3062 and 3064 and thereby an amount of clamping pressure exerted by the sidewall 3072 of the sleeve 3060 on the end portions 3040 and 3050, respectively. In this manner, the sidewall 3072 of the sleeve 3060 may clamp the end portions 3040 and 3050 with a sufficient amount of clamping pressure during operation of the wheelchair 100 to prevent the ends 3062 and 3064 from sliding inside the sleeve 3060. Likewise, the sidewall 3072 of the sleeve 3060 may unclamp the end portions 3040 and 3050 (i.e., reduce the amount of clamping pressure sufficiently) to allow the length of the camber tube 3000' to be adjusted.

Figure 9:
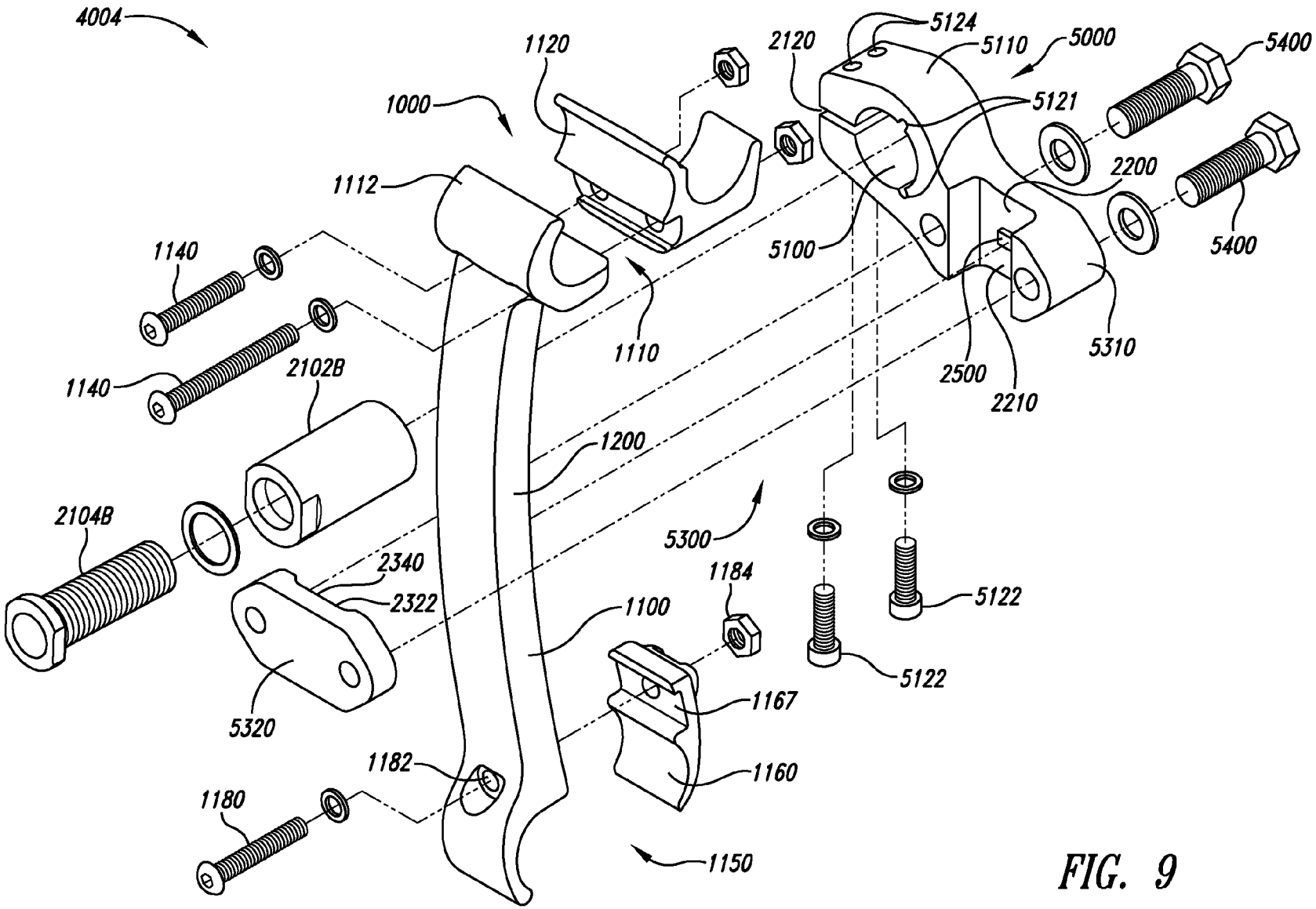
FIG. 9 is an enlarged exploded perspective view of an alternated embodiment of a rear wheel mounting assembly.

Referring to FIG. 9, an alternate embodiment of a right rear wheel mounting assembly 4004 will be described in detail. Components of the right rear wheel mounting assembly 4004 that are substantially identical to corresponding components of the right rear wheel mounting assembly 1004 (see FIG. 3) have been identified with the same reference numerals used to describe the right rear wheel mounting assembly 1004. As is appreciated by one of ordinary skill in the art, a wheelchair constructed using the right rear wheel mounting assembly 4004 may include a left rear wheel mounting assembly (not shown) that is substantially identical to or mirror images of the right rear wheel mounting assembly 4004.

The right rear wheel mounting assembly 4004 may include a camber mounting assembly 1000 clamped to the frame 200 and a camber clamping assembly 5000 clamped to the camber mounting assembly 1000. Like the camber clamping assembly 2000, the camber clamping assembly 5000 includes a collar portion 5110 and a clamp 5300 having a base portion 5310 and a clamping member 5320. The collar portion 5110, the base portion 5310, and the clamping member 5320 are configured to be formed by machining a metal such as aluminum, steel, zinc, and the like. As is appreciated by those of ordinary skill in the art, some of the differences between the camber clamping assembly 5000 and the camber clamping assembly 2000 may be attributable to the methods used in their construction.

The collar portion 5110 of the camber clamping assembly 5000 includes an aperture 5100 configured to receive one of the camber plug 2102A, the camber plug 2102B, the end 3010 of the camber tube 3000, the end 3020 of the camber tube 3000, the end 3010 of the camber tube 3000', and the end 3020 of the camber tube 3000'. The sidewalls of the aperture 5100 may include a cutout portion 2120. One or more fasteners 5122 may be used to determine the width of the cutout portion 2120 for the purposes of changing the cross-sectional area of the aperture 5100 and securely clamping one of the camber plug 2102A, camber plug 2102B, the end 3010 of the camber tube 3000, the end 3020 of the camber tube 3000, the end 3010 of the camber tube 3000', and the end 3020 of the camber tube 3000' within the aperture 5100. The fasteners 5122 may include one or more bolts inserted into through-holes 5124. The sidewalls of the aperture 5100 may include one or more grooves 5121. The grooves 5121 may help the collar portion 5110 clamp more readily around one of the camber plug 2102A, the camber plug 2102B, the end 3010 of the camber tube 3000 (see FIG. 7), the end 3020 of the camber tube 3000 (see FIG. 7), the end 3010 of the camber tube 3000' (see FIG. 8), and the end 3020 of the camber tube 3000' (see FIG. 8).

The camber clamping assembly 5000 includes an upright channel 2200 having a bottom surface 2210 with an outwardly projecting projection 2500 extending transverse to the upright channel. The upright channel 2200 is formed in the base portion 5310 of the clamp 5300. In the embodiment depicted in the drawings, the clamping member 5320 is removably attached to the base portion 5310 by one or more fasteners 5400. The fasteners 5400 may include any suitable fastener such as bolts, screws, and the like. Alternatively, any connector known in the art may be used to attach the clamping member 5320 to the base portion 5310.

When the clamping member 5320 is fastened to the base portion 5310 (i.e., the clamp 5300 is closed around the body portion 1200), the body portion 1200 of the elongated vertical member 1100 is positioned in the upright channel 2200 and clamped between a clamping surface 2340 of the clamping member 5320 and the bottom surface 2210 of the upright channel 2200 formed in the base portion 5310. In the embodiment depicted in FIG. 9, a pair of fasteners 5400 flank the upright channel 2200 and a portion the body portion 1200 of the elongated vertical member 1100 disposed therein.

The projection 2500 extends toward the clamping member 5320 from the bottom surface 2210 of the upright channel 2200 and is received into a selected one of the recesses 1220 (see FIG. 4), thus setting the height of the rear axle 406 and hence the right rear wheel 402, relative to the frame 200 of the wheelchair 100. In this manner, the height of the camber clamping assembly 5000 may be adjustably set, and the camber clamping assembly 5000 prevented from sliding vertically along the elongated upright member 1100 by the clamping action and the projection 2500 disposed within the selected one of the recesses 1220 during use of the wheelchair 100. The vertical position of the camber clamping assembly 5000 relative to the frame 200 is determined by the recess 1220 into which the projection 2500 is inserted. By adjusting the fasteners 5400, the clamping force exerted by the clamp 5300 on the portion of the body portion 1200 sandwiched between the clamping member 5320 and the bottom surface 2210 of the upright channel 2200 may be adjusted. The inwardly directed force of the clamp 5300 maintains the projection 2500 within the recess 1220.

In various embodiments, the collar portion 5110 may be integrally formed with the base portion 5310 and the two together may be about 3.1 inches to about 4.2 inches long, about 1.8 inches to about 2.4 inches wide, and about 0.6 inches to about 1.2 inches thick. In one embodiment, the collar portion 5110 and the base portion 5310 together are about 3.689 inches long, about 2.13 inches wide, and about 0.875 inches thick. In embodiments wherein the aperture 5100 has a circular cross-sectional shape, the aperture 5100 may have a radius of about 0.4 inches to about 0.6 inches. In one embodiment, the aperture 5100 may have a radius of about 0.52 inches to accommodate generally cylindrically shaped camber plug 2102B, camber tube 3000, or camber tube 3000' each having an outside diameter of about one inch. The upright channel 2200 may have a depth of about 0.25 inches to about 0.75 inches. In particular embodiments, the upright channel 2200 has a depth of about 0.5 inches.

The clamping member 5320 may be about 1.7 inches to about 2.8 inches long, about 1.0 inch to about 1.4 inches wide, and about 0.2 inches to about 0.5 inches thick. In one embodiment, the clamping member 5320 is about 2.258 inches long, about 1.125 inches wide, and about 0.375 inches thick. The fasteners 5400 may be spaced apart center-line-to-center-line by about 1.0 inch to about 2 inches. In one embodiment, the fasteners 5400 may be spaced apart center-line-to-center-line about 1.504 inches. The upright channel 2322 formed in the clamping member 5320 may have a width of about 0.7 inches to about 1.1 inches and a depth of about 0.15 inches to about 0.07 inches. In particular embodiments, the upright channel 2322 has a width of about 0.961 inches and a depth of about 0.094 inches.

The projection 2500 illustrated in FIG. 9 has a generally rectangular shape and may extend about 0.06 inches to about 0.1 inches from the bottom surface 2210. In one embodiment, the projection 2500 may extend about 0.08 inches from the bottom surface 2210. The projection 2500 may be about 0.2 inches to about 0.3 inches long and about 0.15 inches to about 0.2 inches wide. In one embodiment, the projection 2500 is about 0.263 inches long and about 0.178 inches wide.

The height of the right rear wheel axle 406 relative to the frame 200 may be adjusted by unclamping the clamp 5300 from the elongated upright member 1100, moving the right rear wheel mounting assembly 4004 vertically to the desired position, inserting the projection 2500 into a recess 1220 at or near the desired position, and reclamping the clamp 5300 to the elongated upright member 1100. The clamp 5300 may be unclamped from the elongated upright member 1100 by loosening or removing the one or more fasteners 5400 and withdrawing the projection 2500 from the selected recess 1220 in which the projection 2500 was received.

Sufficiently loosening the fasteners 5400 may withdraw them from the clamping member 5320 thereby detaching it from the base portion 5310. Further, removing the fasteners 5400 will detach the clamping member 5320 from the base portion 5310. When the clamping member 5320 is detached from the base portion 5310, the clamp 5300 is unclamped from the elongated upright member 1100 and the height of the right rear wheel axle 406 relative to the frame 200 may be adjusted by moving the right rear wheel mounting assembly 4004 vertically to the desired position, inserting the projection 2500 into a recess 1220 at or near the desired position, and reclamping the clamp 5300 to the elongated upright member 1100 by reattaching the clamping member 5320 to the base portion 5310.

While the FIG. 9 depicts an embodiment having a single projection 2500 received into one of the recesses 1220, it is apparent to those of ordinary skill in the art that embodiments including more than one projection received into more than one recess are within the scope of the invention. Optionally, the projection 2500 may be placed near the center of the camber clamping assembly 5000 along the vertical axis. Alternatively, the projection 2500 may be placed off center along the vertical axis to allow a larger range of adjustment.

Optionally, an upright channel 2322 may be formed in the clamping member 5320. The upright channel 2322 may be positioned opposite the upright channel 2200 when the clamping member 2320 is fastened to the base portion 2310. The clamping member 5320 may be shaped and sized to conform to the outside surface 1210 of the body portion 1200 of the elongated vertical member 1100 to increase the surface area of the clamping surface 2340.

As is appreciated by those of ordinary skill in the art, in embodiments wherein the left rear wheel mounting assembly (not shown) is a mirror image of the right rear wheel mounting assembly 4004, at least eight unique assemblies of the camber mounting assembly 1000 and camber clamping assembly 5000 along the right side 204 of the wheelchair 100 are possible. These eight unique assemblies are the same as those described above with respect to the camber mounting assembly 1000 and camber clamping assembly 2000. Each of the unique assemblies of the camber mounting assembly 1000 and camber clamping assembly 5000 may provide a unique range of vertical and/or horizontal rear wheel position options. To increase the range of adjustment, the aperture 5100 may be positioned at a different vertical height than the projection 2500, e.g., the center of the aperture 5100 may be vertically offset from the projection 2500.

As mentioned above and appreciated by those of ordinary skill in the art, the components of the left rear wheel mounting assembly (not shown) corresponding to the right rear wheel mounting assembly 4004 may have substantially the same construction as the components described above with respect to the right rear wheel mounting assembly 4004. In some embodiments, the left and right camber clamping assemblies 5000 of the right rear wheel mounting assembly 4004 and its corresponding left rear wheel mounting assembly (not shown), respectively, may also may be connected by a single camber tube 3000 or 3000'.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A wheelchair comprising:

a frame having a side, an upper longitudinal member disposed along the side of the frame, and lower longitudinal member vertically spaced from the upper longitudinal member and disposed along the side of the frame;

at least one rear wheel having an axle;

an elongated upright member comprising:

a first clamp adjacent to a first end of the elongated upright member clampable to the upper longitudinal frame member, a second clamp adjacent to a second end of the elongated upright member clampable to the lower longitudinal frame member, an elongated body portion extending between the first and second ends of the elongated upright member, a plurality of recesses arranged longitudinally along the elongated body portion and extending only partially therethrough; and, a camber clamping assembly having an aperture configured to receive and retain the axle of a rear wheel and a third clamp releasably clampable to a portion of the elongated body portion of the elongated upright member, the third clamp including a projection selectively positionable within a selected one of the plurality of recesses of the elongated upright member.

2. The wheelchair of claim 1, wherein the plurality of recesses arranged longitudinally along the elongated body portion are spaced apart from one another.

3. The wheelchair of claim 1, wherein the elongated body portion comprises an inwardly facing side and the plurality of recesses are arranged longitudinally along the inwardly facing side of the elongated body portion.

4. The wheelchair of claim 1, wherein the aperture for receiving and retaining the axle of the rear wheel has a center and the center is vertically offset from the third clamp.

5. The wheelchair of claim 1, wherein the third clamp includes an interior surface with projection extending less than 0.5 inches outwardly from the interior surface.

6. The wheelchair of claim 1, wherein the first clamp includes a fastener selectively adjustable to generate a selected clamping force exerted by the first clamp on the upper longitudinal frame member, and the first clamp is configured to selectively slide along the upper longitudinal frame member when the clamping force is below a predetermined level to permit adjustment of the position of the first clamp along the upper longitudinal frame member.

7. The wheelchair of claim 1, wherein the second clamp includes a fastener selectively adjustable to generate a selected clamping force exerted by the second clamp on the lower longitudinal frame member, and the second clamp is configured to selectively slide along the lower longitudinal frame member when the clamping force is below a predetermined level.

8. The wheelchair of claim 1, wherein the third clamp comprises a clamping member pivotally mounted to a base portion, the base portion comprises an upright channel, the projection extends outwardly from the upright channel, the clamping member is configured to selectively clamp the portion of the elongated body portion of the elongated upright member within the upright channel with the projection within the selected one of the plurality of recesses of the elongated upright member, the clamping member is configured to be positioned opposite the upright channel when the clamping member is pivoted toward the camber clamping assembly, and the camber clamping assembly comprises a removable fastener that fastens the clamping member to the base portion to prevent the clamping member from pivoting away from the camber clamping assembly after the portion of the elongated upright member is positioned in the upright channel.

9. The wheelchair of claim 8, wherein the third clamp comprises a clamping member pivotally mounted to a base portion, the base portion comprises an upright channel, the projection extends outwardly from the upright channel, the clamping member is configured to selectively clamp the portion of the elongated body portion of the elongated upright member within the upright channel with the projection within the selected one of the plurality of recesses of the elongated upright member, the clamping member comprises a groove with a clamping surface, configured to receive and selectively clamp therein a portion of the elongated upright member, and the upright channel includes a clamping surface, the clamping member being configured to clamp the elongated upright member between the clamping surface of the upright channel and the clamping surface of the groove of the clamping member.

10. The wheelchair of claim 1, wherein the third clamp comprises a clamping member removably attached to a base portion having an upright channel, the projection extends outwardly from the upright channel, and the clamping member selectively clamps the portion of the elongated body portion of the elongated upright member within the upright channel with the projection within the selected one of the plurality of recesses of the elongated upright member.

11. The wheelchair of claim 10, wherein the clamping member of the third clamp is attached to the base portion by at least one fastener, the at least one fastener being configured to determine a pressure at which the clamping member selectively clamps the portion of the elongated body portion of the elongated upright member within the upright channel.

12. The wheelchair of claim 10, wherein the clamping member is attached to the base portion by a pair of fasteners that flank the upright channel.

13. A rear wheel mounting assembly for a wheelchair having a frame and a rear wheel with an axle, comprising:

an upright member having a first surface and a second surface opposite the first surface, the first surface comprising a plurality of vertically arranged recesses extending inwardly toward the second surface and terminating inside the upright member before reaching the second surface, the upright member being coupleable to the frame;

a camber clamping assembly having an aperture for receiving the axle of the rear wheel and a base portion with an upright channel with an outwardly extending projection disposed therein, a portion of the elongated upright member being received within the upright channel of the base portion with the outwardly extending projection disposed within a selected one of the plurality of vertically arranged recesses; and a clamping member coupled to the base portion and configured to selectively clamp the portion of the elongated upright member within the upright channel with the outwardly extending projection within the selected one of the plurality of vertically arranged recesses.

14. The rear wheel mounting assembly of claim 13, wherein the clamping member is pivotally mounted to the base portion, the clamping member being configured to be positioned opposite the upright channel when the clamping member is pivoted toward the camber clamping assembly, and further including a removable fastener that fastens the clamping member to the base portion to prevent the clamping member from pivoting away from the camber clamping assembly after the portion of the elongated upright member is positioned in the upright channel.

15. The rear wheel mounting assembly of claim 13, wherein the aperture for receiving the axle of the rear wheel has a center and the center is vertically offset from the outwardly extending projection.

16. The rear wheel mounting assembly of claim 13, wherein the clamping member comprises a groove with a clamping surface, configured to receive and selectively clamp therein a portion of the elongated upright member, and wherein the upright channel includes a clamping surface, the clamping member being configured to clamp the elongated upright member between the clamping surface of the upright channel and the clamping surface of the groove of the clamping member.

17. A wheelchair comprising:

a frame having a left and right side; and a rear wheel mounting assembly comprising:

a first elongated upright member coupled to the left side of the frame comprising a first outside surface, a second outside surface opposite the first outside surface, and a plurality of spaced apart recesses arranged longitudinally along the first outside surface of the first elongated upright member, the recesses extending inwardly toward the second outside surface but terminating before reaching the second outside surface;

a second elongated upright member coupled to the right side of the frame, comprising a first outside surface, a second outside surface opposite the first outside surface, and a plurality of spaced apart recesses arranged longitudinally along the first outside surface of the second elongated upright member, the recesses extending inwardly toward the second outside surface but terminating before reaching the second outside surface;

a first camber clamping assembly comprising a first aperture adjacent to a first removable clamp, wherein the first removable clamp has a first clamp surface configured to engage a portion of the first elongated upright member and the first clamp surface comprises a first projection that is received within one of the recesses of the plurality when the first clamp surface engages the portion of the first elongated upright members; and a second camber clamping assembly comprising a second aperture adjacent to a second removable clamp, wherein the second removable clamp has a second clamp surface configured to engage a portion of the second elongated upright member and the second clamp surface comprises a second projection that is received within one of the recesses of the plurality when the second clamp surface engages the portion of the second elongated upright members.

18. The wheelchair of claim 17, wherein the rear wheel mounting assembly comprises a camber tube having a first and second end, a portion of the first end is received into the first aperture;

a portion of the second end is received into the second aperture;

the first end comprises an aperture configured to receive a portion of a first axle and the second end comprises an aperture configured to receive a portion of a second axle.

19. The wheelchair of claim 18, wherein the camber tube comprises an adjustable portion that determines a distance between the first and second ends of the camber tube.

* * * * *